United States Patent [19]

Ortyl

[11] Patent Number: 4,570,747

[45] Date of Patent: Feb. 18, 1986

[54] MECHANICAL LOCK JOINT FOR JOINING TUBULAR PRODUCTS

[75] Inventor: George M. Ortyl, West Chicago, Ill.

[73] Assignee: Maremont Corporation, Chicago, Ill.

[21] Appl. No.: 651,840

[22] Filed: Sep. 18, 1984

[51] Int. Cl.[4] ..... F01N 7/18

[52] U.S. Cl. ..... 181/243; 181/255; 181/272; 285/DIG. 22

[58] Field of Search ..... 181/243, 247–252, 181/255, 272; 285/189, 192, 222, 382.2, 382.4, 382.5, DIG. 22; 138/161–168

[56] References Cited

U.S. PATENT DOCUMENTS 3,885,298 5/1975 Pogonowski ..... 285/382.4

4,334,703 6/1982 Arthur et al. ..... 285/222

*Primary Examiner*—Benjamin R. Fuller

*Attorney, Agent, or Firm*—Allegretti, Newitt, Witcoff & McAndrews, Ltd.

[57] ABSTRACT

In a vehicular exhaust system muffler, two telescoped tubes and internal panel are joined by a wholly mechanical joint. Two axially spaced beads extend about the tubes. The beads are integral to the tubes, annular, and radially outwardly extending. An annular flange of the panel extends along the outer tube. A plurality of integral, interlocking protrusions are simultaneously deformed into the outer tube and flange. The beads, flange and protrusions totally mechanically join the tubes and internal panel.

3 Claims, 3 Drawing Figures

MECHANICAL LOCK JOINT FOR JOINING TUBULAR PRODUCTS

BACKGROUND OF THE INVENTION

This invention relates to vehicular exhaust system mufflers, and more specifically, to the joints of internal components of the mufflers.

Spot welding is commonly used in the fabrication of vehicular exhaust system mufflers. As evidenced by U.S. Pat. Nos. 2,367,753; 3,557,903; and 3,608,667, spot welding has long been considered less than perfect as a jointing technique. A variety of reasons exist. First, spot welded joints may be difficult to inspect. Second, spot welding may radically change the internal structure of the jointed members within and adjacent the spot welded joints. Third, spot welding may destroy the continuity of protective coatings on the jointed members. Fourth, joint member alignment may suffer due to material distortion during welding. Fifth, harmful metallic gases may be generated by spot welding, especially with galvanized materials. Sixth, time is required for spot welded joints to cool before further handling. For these and other reasons quality control, speed and safety may not be achieved to an extent desired. For these same reasons, mechanical joints have been attempted in the fabrication of vehicular exhaust system mufflers. Like welded joints, mechanical joints must provide acceptable, if not superior and excellent, tensile, compressive and torsional strengths between mated muffler components, as well as acceptable fatique life and an acceptable seal against gas leakage. While the foregoing patents disclose such attempts, to date, superior mechanical joints have remained unachieved in muffler fabrication.

SUMMARY OF THE INVENTION

In a principal aspect, this invention is an improved, wholly mechanically joint in a vehicular exhaust system muffler. The muffler has a housing with a shell and end panels. First tubes extend from the housing exterior through the end panels and into internal panels within the housing. Second tubes extend between the internal panels.

The invented mechanical joint joins each first tube, second tube and internal panel. The second tube has an end portion extending into the first tube. The panel has a first tube opening defined by an integral, annular flange on the panel. The flange extends along the first tube outward of the first tube and of the end portion of the second tube.

The flange and first tube are deformed together into a plurality of circumferentially spaced, interlocked protrusions. The first and second tubes are deformed on opposite sides of the protrusions into two integral, annular, radially outwardly extending beads or rings. The beads and protrusions form a joint which is wholly mechanical, and superior in performance.

These and other objects, aspects and advantages of the invention are more fully set forth in the detailed description of the preferred embodiment, which follows a brief description of the accompanying drawing.

DETAILED DESCRIPTION OF THE PREFERRED EMBODIMENT

Figure 1:
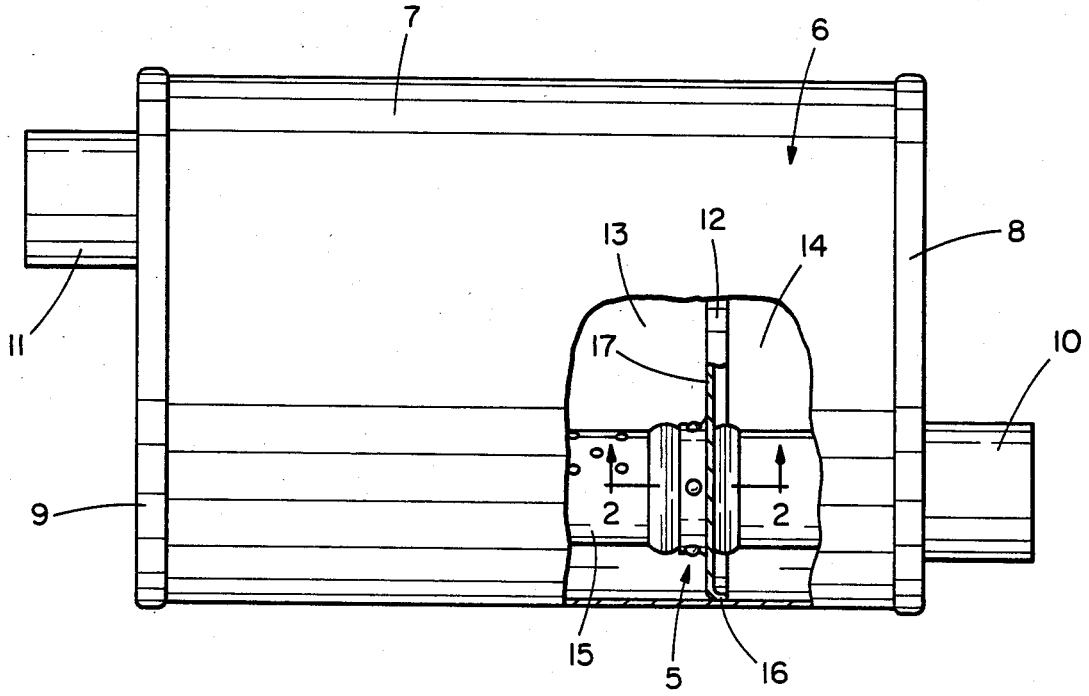
FIG. 1 is a view of a muffler with a portion broken away to reveal internal detail and the joint which is the preferred embodiment of the invention.

The preferred embodiment of the invention is a mechanical joint 5 in a muffler 6. A shell 7 of the muffler 6 is wrapped about and joined to two conical end panels 8, 9. A first tube 10 leads into the muffler 6 from the muffler exterior through the end panel 8, and another first tube 11 leads out from the muffler 6 through the end panel 9. The tubes 10, 11 extend into internal panels such as panel 12 within the interior of the muffler 6. The internal panels divide the muffler interior into a plurality of chambers such as chambers 13, 14.

The first tube 10 is joined to the internal panel 12 by the joint 5, and the tube 11 is also joined to an internal panel by another joint 5 (not shown as to tube 11). Each tube 10, 11 is elongated, cylindrical, and of substantially uniform diameter throughout its length (except as described below).

The tubes 10, 11 are outer tubes of the muffler 6. There are two internal or second tubes, such as tube 15. Each internal tube extends between the internal panels. The internal tubes are also elongated, cylindrical, and of substantially uniform diameter throughout (except as described below).

With reference in the drawing to internal panel 12 only, each internal panel includes a rim 16 and a central portion 17. The portion 17 is substantially planar.

Figure 2:
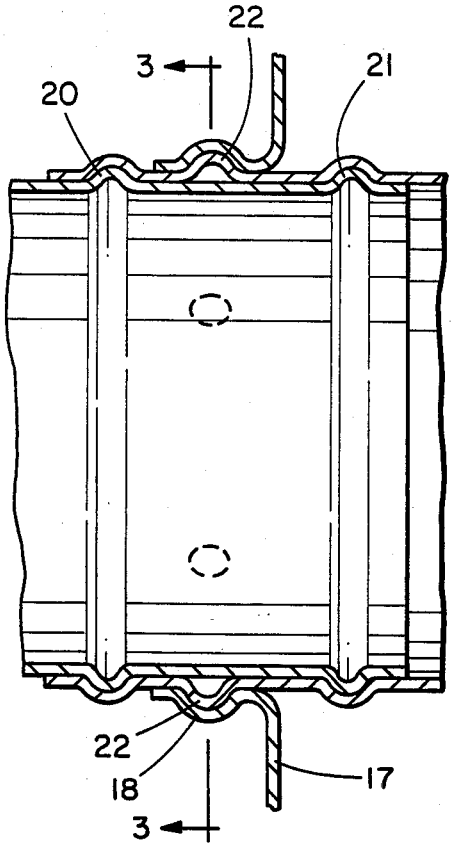
FIG. 2 is a cross-section view of the preferred embodiment taken along line 2—2 of FIG. 1.

The portion 17 includes a flange 18, best seen in FIG. 2. The flange 18 is integral to the portion 17, annular, and defines an annular opening through the portion 17 for the tubes. The flange 18 extends perpendicularly to the central portion 17, and axially along the outer tube 10. The flange is external to the outer tube 10, and the inner diameter of the flange 18 is substantially equal to the outer diameter of the outer tube 10.

The internal tube 15 is telescoped within the outer tube 10, under the flange 18. The outer diameter of the tube 15 is substantially equal to the inner diameter of the tube 10. By definition of the term "telescoped", an end portion of the tube 15 is within an end of the tube 10. The tube 15 is telescoped under the flange 18 in that the flange 18 extends axially along the telescoped end portion and end of the tubes 10, 15.

Two beads 20, 21 are formed in the tubes 10, 15. The beads in axial cross-section of the tube as in FIG. 2, are each 20, 21 substantially semicircular. Each bead 16 is integral to each tube and is a ring or localized, annular, radially outwardly extending enlargement of the tube. The beads join the tubes against axial movement of the tubes relative to each other.

Figure 3:
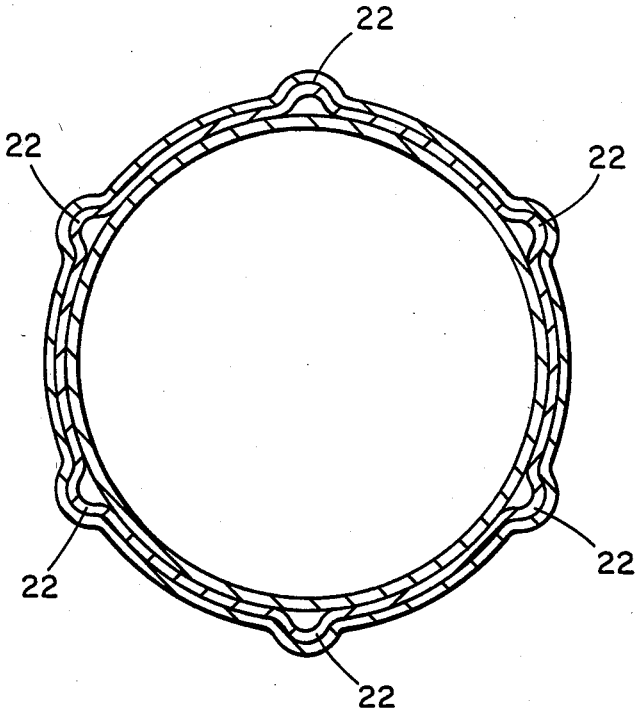
FIG. 3 is a cross-section view taken along line 3—3 of FIG. 2.

As shown best in FIG. 3, a plurality of protrusions 22 are formed in the flange 18 and outer tube 10 axially between the beads 20, 21. The protrusions 22 are formed simultaneously in the flange 18 and outer tube 10, from within the tube 10. The protrusions are formed by deformation of the flange and tube, through cooperation of an expanding, internal punch and an external die. The protrusions are circumferentially spaced about a single diameter of the flange and tube. In any cross-section, the protrusions are substantially semicircular, and thus, are substantially hemispherical overall. The protrusions protrude to the exterior of the flange and tube.

The radii of the flange interior surface and the tube exterior surface within the protrusions are substantially equal, and the centers of curvature are at the same point. The flange interior surface within the protrusions substantially completely contacts the tube exterior surface. As a result, the protrusions are highly effective to fix the outer tube and flange relative to each other both axially and radially.

The joint 5 is now fully described. The joint 5 is not spot welded, and no other supplementary joining mechanism is included in the joint. The beads, flange and protrusions are the sole means of joining the tube and end panel. The joint 5 is totally mechanical. The beads, flange and protrusions cooperate to mechanically join the tubes and internal panel in fixed axial and radial positions against tensile, compressive and torsional forces and pressures. The beads, flange and protrusions also effectively create a gas seal between the panel and tubes.

The joint 5 has a variety of important advantages. The joint 5 can be quickly and easily formed. As soon as formed, the joint is effective, and need not be cooled or otherwise set. No gases are created because no chemical reaction occurs. Protective coatings are not compromised. Material internal structure is not significantly altered, and the joint 5 is easy to inspect. Joint strength is superior.

The preferred embodiment of the invention is now described. This preferred embodiment constitutes the best mode contemplated by the inventor of carrying out the invention. The invention, and the manner and process of making and using it, have been described in full, clear, concise and exact terms to enable any person skilled in the art to make and use the same. Because the invention may be copied without the copying of the precise details of the preferred embodiment, the following claims particularly point out and distinctly claim the subject matter which the inventor regards as his invention and wishes to protect.

What is claimed is:

1. In a vehicular exhaust system muffler having a housing with a shell, end panels, at least a first internal panel, and at least a first tube and a second tube, the second tube being telescoped within the first tube, the improvement of a mechanical joint joining the first tube, the second tube and the first internal panel, the joint comprising:

a plurality of spaced, integral, annular, radially outwardly extending beads on the first tube and the telescoped second tube, a tube opening in the first internal panel, an integral, annular flange of said first internal panel adjacent the tube opening, the flange extending along the first tube and being outward of the first tube and between the beads, the first tube extending through the opening within the flange, and a plurality of integral, interlocking protrusions on the first tube and flange between the beads.

2. A joint as in claim 1 in which the beads, flange and protrusions constitute means for totally mechanically joining the panel and tubes.

3. A joint as in claim 1 in which the beads, flange and protrusions constitute means for mechanically joining the panel and tubes in fixed axial and radial positions against tensile, compressive and torsional forces and pressures.

* * * * *